US011060360B2

(12) United States Patent
Mikalsen

(10) Patent No.: US 11,060,360 B2
(45) Date of Patent: Jul. 13, 2021

(54) APPARATUS AND METHOD FOR GRIPPING A TUBULAR MEMBER

(71) Applicant: Canrig Robotic Technologies AS, Sandes (NO)

(72) Inventor: Kenneth Mikalsen, Sandnes (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 15/564,848

(22) PCT Filed: Apr. 4, 2016

(86) PCT No.: PCT/NO2016/050062

§ 371 (c)(1),
(2) Date: Oct. 6, 2017

(87) PCT Pub. No.: WO2016/163890

PCT Pub. Date: Oct. 13, 2016

(65) Prior Publication Data

US 2018/0112476 A1 Apr. 26, 2018

(30) Foreign Application Priority Data

Apr. 7, 2015 (NO) ..... 20150401

(51) Int. Cl.
*E21B 19/16* (2006.01)
*B25B 5/16* (2006.01)
*B25B 5/14* (2006.01)

(52) U.S. Cl.
CPC ..... *E21B 19/16* (2013.01); *B25B 5/163* (2013.01); *B25B 5/166* (2013.01); *B25B 5/147* (2013.01)

(58) Field of Classification Search
CPC ..... B25B 5/163; B25B 5/166; B25B 5/147; E21B 19/16
(Continued)

(56) References Cited

U.S. PATENT DOCUMENTS 1,758,108 A * 5/1930 Goeser ..... E21B 19/10 175/423
1,836,680 A * 12/1931 Nixon ..... E21B 19/10 175/423
(Continued)

FOREIGN PATENT DOCUMENTS

WO 9810899 3/1998
WO 9836873 8/1998
(Continued)

OTHER PUBLICATIONS

Search Report for Norwegian Applicationo No. 20150401 (2 pages).
(Continued)

*Primary Examiner* — Hadi Shakeri
(74) *Attorney, Agent, or Firm* — Abel Schillinger, LLP; Enrique Abarca

(57) ABSTRACT

Apparatus for gripping a tubular member where the apparatus includes a die and a die holder, and where at least one of the die or the die holder, on its portion facing the other, has at least two axially formed ridges that complementary fit in valleys in the other of the die or the die holder. The ridges have a larger bottom width than top width. The centre lines of the die ridges are substantially parallel at a distance, and the die, when unengaged, is radially movable between abutment of the die ridges to the die holder and abutment of the die to at least one stop member of the die holder.

12 Claims, 5 Drawing Sheets

(58) Field of Classification Search
USPC ..... 81/57.33
See application file for complete search history.

(56) References Cited

U.S. PATENT DOCUMENTS 2,933,961 A * 4/1960 Adams ..... E21B 19/164 81/57.11
3,675,278 A * 7/1972 Powell ..... E21B 19/07 294/102.2
4,576,067 A 3/1986 Buck
4,631,987 A 12/1986 Buck
4,836,064 A * 6/1989 Slator ..... B25B 5/147 81/57.15
5,845,549 A 12/1998 Bouligny
6,070,500 A 6/2000 Diask
6,378,399 B1 4/2002 Bangert
6,637,296 B1 * 10/2003 Dagenais ..... E21B 19/161 81/185.1
6,971,283 B2 * 12/2005 Belik ..... B25B 5/147 81/186
7,219,580 B2 * 5/2007 Dagenais ..... E21B 19/164 81/57.18
7,231,984 B2 * 6/2007 Jaensch ..... B25B 13/5016 166/380
8,601,911 B1 * 12/2013 Baryam ..... B25B 13/52 81/57.15
2004/0051259 A1 3/2004 Belik
2004/0194967 A1 10/2004 Jaensch
2006/0027047 A1 2/2006 Buck
2009/0229424 A1 9/2009 Montgomery
2010/0050407 A1 3/2010 Buck et al.
2011/0132594 A1 * 6/2011 Slack ..... E21B 19/06 166/77.51

FOREIGN PATENT DOCUMENTS

WO 2015/003241 A1 1/2015
WO 2016163890 10/2016

OTHER PUBLICATIONS

PCT Search Report for PCT/NO2016/050062 dated Jun. 28, 2016 (3 pages).
PCT Written Opinion for PCT/NO2016/050062 dated Jun. 28, 2016 (4 pages).
Supplementary European Search Report from EP Application No. 16776974.4 dated Nov. 30, 2018, 2 pgs.

* cited by examiner

III–III

I–I

APPARATUS AND METHOD FOR GRIPPING A TUBULAR MEMBER

CROSS REFERENCE TO RELATED APPLICATIONS

This application is the U.S. National Stage entry under 35 U.S.C. § 371 of International Patent Application No. PCT/NO2016/050062, filed Apr. 4, 2016, and entitled "Apparatus and method for gripping a tubular member," which claims priority to Norwegian Application No. 20150401, filed Apr. 7, 2015, both of which being incorporated herein by reference in their entireties for all purposes.

BACKGROUND

The present disclosure concerts an apparatus for gripping a tubular member.

When gripping tubular members, as is well known from the petroleum drilling industry, a number of spaced apart grippers are forced against the tubular member. The grippers, that have specially prepared contact surfaces facing towards the tubular member, are subjected to heavy wear.

It is well known to utilize a fairly hard material body, termed die, as a wear member. The die is fixed in a die holder, and designed to be easily exchangeable.

WO 9810899 discloses a die that has a specially prepared gripping surface facing towards the tubular member. The portion facing the die holder has a number of axially formed ridges and valleys that are spaced in a semi-circular manner. The ridges and valleys, of the die correspond to ridges and valleys in a die holder.

U.S. Pat. No. 5,845,549 shows a number of dies placed in a ring of fixed diameter. The dies are radially adjustable in the ring.

U.S. Pat. No. 6,070,500 discloses a die that is fixed in a dove tail slot, and where the die is allowed to align itself against a pipe.

During operation of the gripper, the forces acting tend to deform the die. One result of such deformation is that the relatively narrow clearances that initially exist between the die and the die holder are closed. Removing a deformed die from the die holder may be nearly impossible while the die holder is in its operational position.

BRIEF SUMMARY OF THE DISCLOSURE

The present disclosure concerns an apparatus for gripping a tubular member where the apparatus includes a die and a die holder, and where at least one of the die or the die holder, on its portion facing the other, has at least two axially formed ridges that complementary fit in valleys in the other of the die or the die holder, the ridges having a larger bottom width than top width. Further, the present disclosure includes a method for gripping a tubular member. The present disclosure may remedy or reduce at least one of the drawbacks of the prior art, or at least provide a useful alternative to prior art.

According to the present disclosure, a contact surface between the die and the die holder is designed to allow some deformation of the die without locking the die to the die holder, while at the same time keeping the die in its correct orientation relative a tubular member.

The die is, when unengaged, allowed to some radial movement relative the die holder.

By maintaining the looseness of the die in the die holder, the die may be removed from the die holder by the use of a relatively simple manual or mechanised tool.

In a first aspect the present disclosure relates more particularly to an apparatus for gripping a tubular member where the apparatus includes a die and a die holder, and where at least one of the die or the die holder, on its portion facing the other, has at least two axially, in the direction of the tubular member when engaged by the die, formed ridges that complementary fit in valleys in the other of the die or the die holder, the ridges having a larger bottom width than top width in the radial direction from the die or die holder towards the other of the die or die holder, wherein radial centre lines of the die ridges are substantially parallel, and where the die, when unengaged, is radially movable between abutment of the die ridges to the die holder and abutment of the die to at least one stop member of the die holder.

Herein, the terms "radial" and "axial" refer to the radial and axial directions, respectively, of a pipe when engaged by the die. Further, terms like "upper", "lower" and "vertical" refer to the items when in their working positions.

When the die ridges are positioned in the holder valleys, the die is kept in alignment with the tubular member. As the die ridges are wider at their bottom than at their top, the die ridges has a tapered form in the radial direction that prevents the ridges from being fixed in the holder valleys even when some deformation of the die is experienced.

If the top of the die ridges are positioned along a curved plane, such as shown in WO 9810899, a slight deformation of the die will fix the die in the die holder even with tapered die ridges. According to the present disclosure, the radial centre lines of the die ridges are substantially parallel.

As there is some room for radial movement of the die in the die holder, the die may be lifted from the die holder without the use of heavy forces.

Typically the die ridges are spaced apart by a die valley and the holder valleys are spaced apart by a holder ridge.

The holder ridges may be plough-formed at their upper, axial portion in order to ease the entry of the die into the die holder.

A pair of stop members of the die holder may form a dove tail slot. Generally, the stop member is designed to prevent the die from moving out of the die holder in the radial direction.

A lock member, which is biased towards its locking position, may be present for preventing the die from unintentionally being lifted out of the die holder. Supports in the die holder below the die may prevent the die from falling out from the die holder.

A magnet may be fixed to the die holder close to the die ridges or in the die close to the holder ridges when the die is in its working position in the die holder. The magnet will bias the die towards the die holder, thus avoiding matter, such as drilling mud, from entering between the die and die holder. Such matter between the die and the die holder could enhance wear.

There is also described a tool for moving a die in to or out of a die holder, the tool having a handle or an adapter, wherein the tool has a pair of biased lower bodies that are releasably engageable in corresponding recesses in the die.

When the tool is engaged to the die, the die may be lifted in or out of the die holder by manually or remotely operating the tool. When in position in the die holder, the tool is released from the die.

The tool, when in its active position with the die in the die holder, may abut the lock member, thus keeping the lock member in its released position.

In another embodiment, the die may be placed in to and removed from the die holder without the use of a tool.

In a second aspect, the present disclosure relates more particularly to a method for gripping a tubular member by use of an apparatus according to the first aspect of the present disclosure wherein the method includes:

- releasably latching a tool to the die and sliding the die into the die holder, thereafter releasing the tool from the die;
- gripping and releasing a tubular item by means of the apparatus; and
- lathing the tool to the die and retrieving the die from the die holder.

When a lock member is present, the method includes releasing the lock member prior to retrieval of the die.

The apparatus, tool and method according to the present disclosure are intended to substantially overcome the difficulties experienced when changing dies in a die holder. This is of particular importance when automating drill floors where no manual intervention is intended.

BRIEF DESCRIPTION OF THE DRAWINGS

In the following is described an example of an exemplary embodiment illustrated in the accompanying drawings, wherein.

DETAILED DESCRIPTION OF THE DISCLOSED EXEMPLARY EMBODIMENTS

Figure 1:
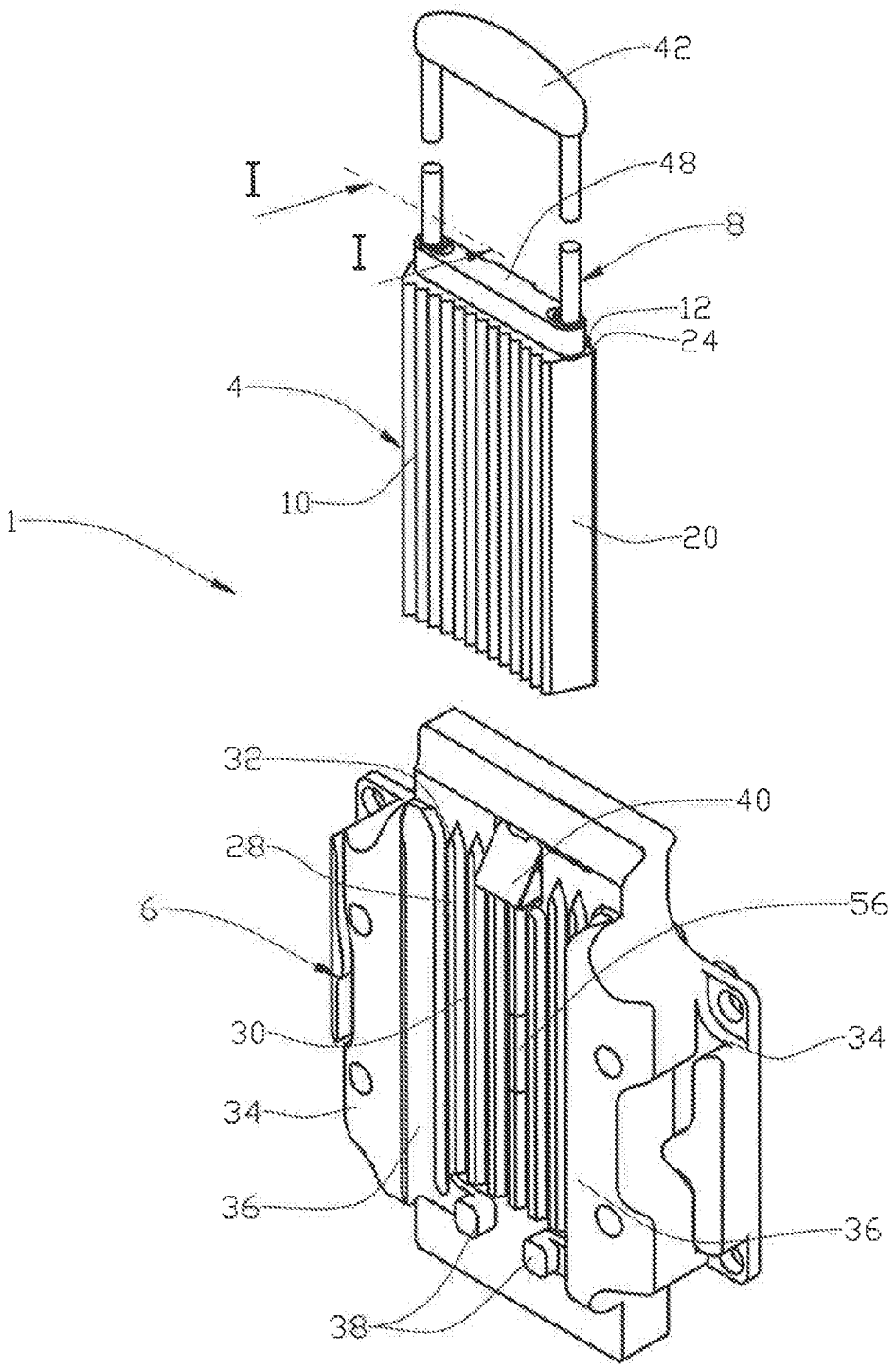
FIG. 1 shows a perspective view of a die and a die holder according to the present disclosure, and where the die is releasably fixed to a tool for inserting the die in the die holder.
Figure 2:
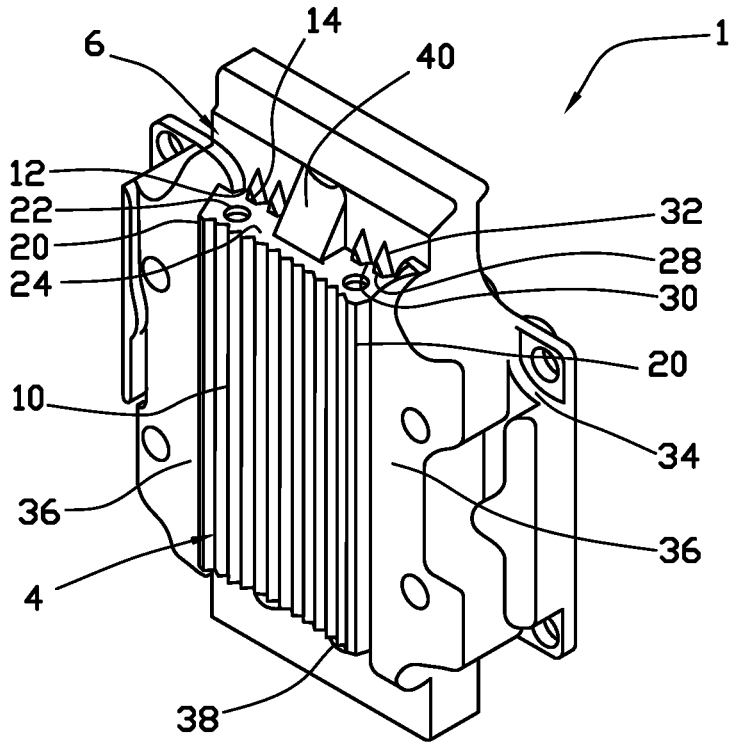
FIG. 2 shows a perspective view of the die in its working position in the die holder, and where the tool is released and removed from the die.

On the drawings, the reference number 1 denotes an apparatus for gripping a tubular member 2. The apparatus 1 includes a die 4 and a die holder 6. In addition, a tool 8 for inserting or retrieving the die 4 to or from the die holder 6 may be included in the apparatus 1.

The apparatus 1 is part of a gripping device, not shown.

The die 4 has on its tubular member 2 facing side a surface 10 that is prepared to give a good grip on the tubular member 2 when forced against it. On its opposite side, facing the die holder 6, the die has a number of die ridges 12 spaced apart by die valleys 14. The die ridges 12 have a larger bottom width 16 than top width 18. Thus, the die ridges 12 have a tapered form. See FIG. 5 and also FIGS. 3-4.

The die 4 has two side portions 20 that are tapered in the direction from the die holder 6 towards the tubular member 2.

Figure 7:
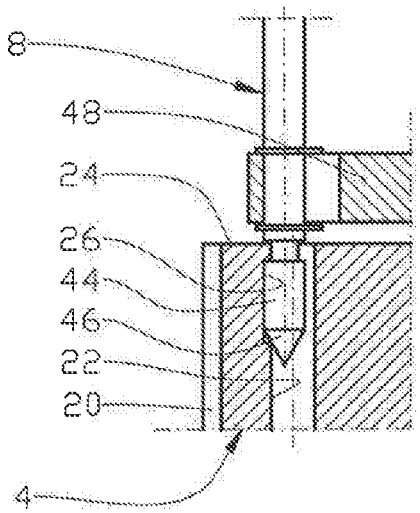
FIG. 7 shows to a larger scale a section I-I in FIG. 1.
Figure 8:
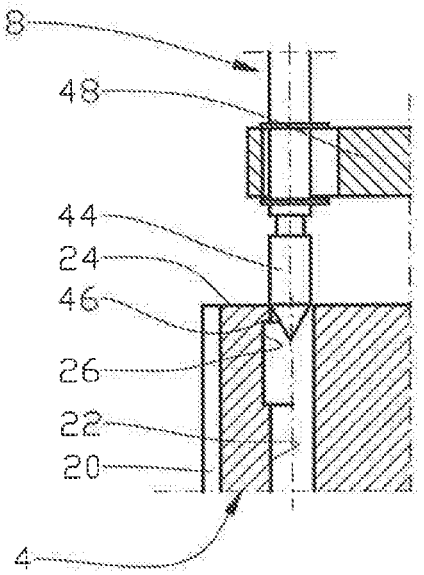
FIG. 8 shows the same as in FIG. 7, but at a preceding stage when a lower body of the tool is entering the die.

A pair of openings 22 extends into the die 4 from the top surface 24 of the die 4. Each of the openings 22 has a recess 26, see FIGS. 7, 8.

The die holder 6 is on its side facing the die 4 equipped with a number of holder ridges 28 that are spaced by holder valleys 30. The holder ridges 28 and holder valleys 30 are designed to interact with the die ridges 12 and die valleys 14. At least some of the holder ridges 28 are upwardly given a plough form 32.

The die holder 6 is equipped with brackets 34 for fixing the die holder 6 to the gripping device not shown.

Stop members 36 are extending forward on each side of the die holder 6, forming a dove tail slot.

At its lower portion, the die holder 6 has a couple of supports 38. A lock member 40 is positioned at the upper portion of the die holder 6 and is movable between a protruding active position and a passive retracted position. The lock member 40 is biased towards its active position. In alternative embodiments, the lock member 40 may be placed on one of the side portions 20 or at the bottom of the die holder 6, instead of at the upper portion. Placement and retrieval of the die 4 to and from the die holder 6 may also be done by means of bare hands without the use of a specifically designed tool 8.

The shown tool 8, that has a handle or adapter 42, has a pair of lower bodies 44 with pointed ends 46. The bodies 44 are designed to be inserted in the openings and releasably latched in the recesses 26.

Figure 9:
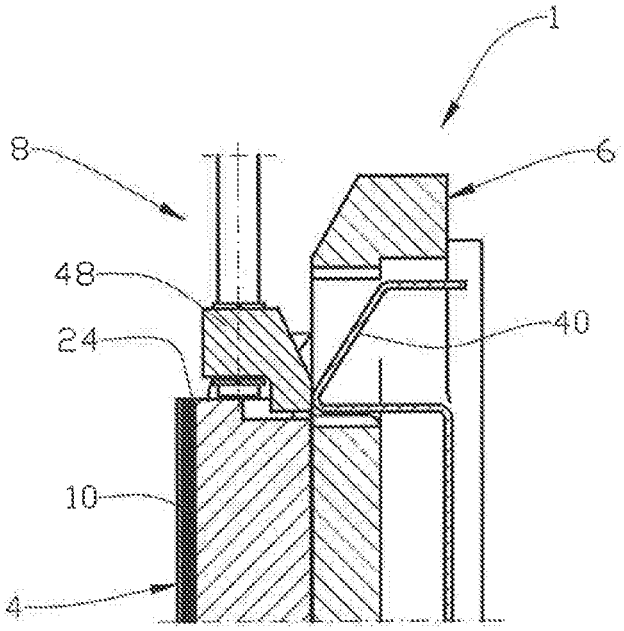
FIG. 9 shows to a larger scale the section III-III in FIG. 3, but with the tool connected to the die.

When the tool 8 is in its latched position with the die 4, and the die 4 is in the die holder 6, a release member 48 abuts the lock member 40 in its released position, see FIG. 9. The release member 48 is designed to move the lock member 40 from its active to its passive, released position when the tool 8 is inserted in the die 4 with the die 4 in the die holder 6.

When the die 4 is inserted in the die holder 6, the plough form 32 of the holder ridges 28 helps in entering the die 4 into the die holder 6. At the same time, the lock member 40 is moved to its passive position. The die 4 is moved downwardly between the holder ridges and valleys 28, 30 and the stop members 36 until the die 4 rests at the supports 38. The tool 8 is then released from the die 4 by moving the lower bodies 44 first out from the recesses 26, and then out of the openings 22. When the tool 8 is removed, the lock member 40 is free to move into its active, locked position.

Figure 3:
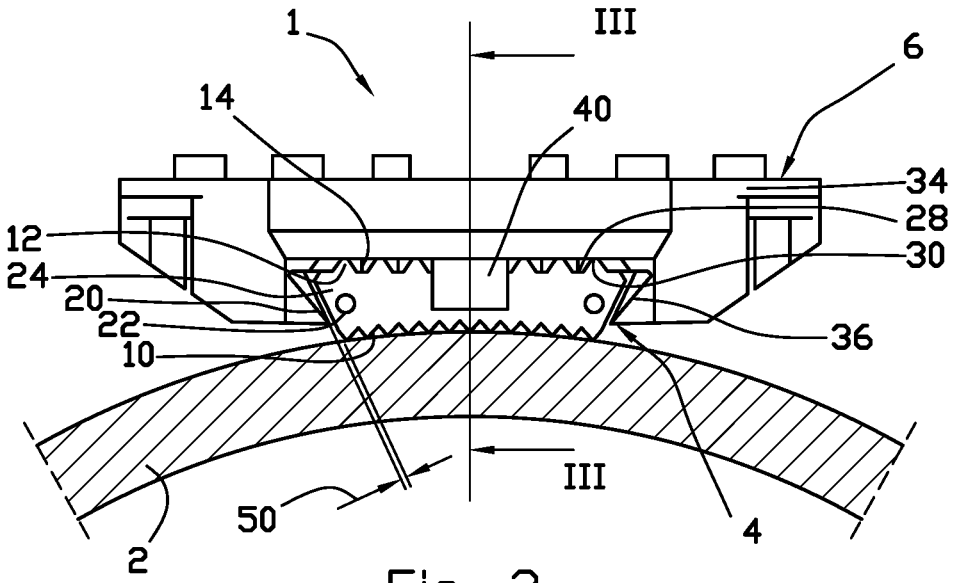
FIG. 3 shows a plane view of the die and die holder.
Figure 4:
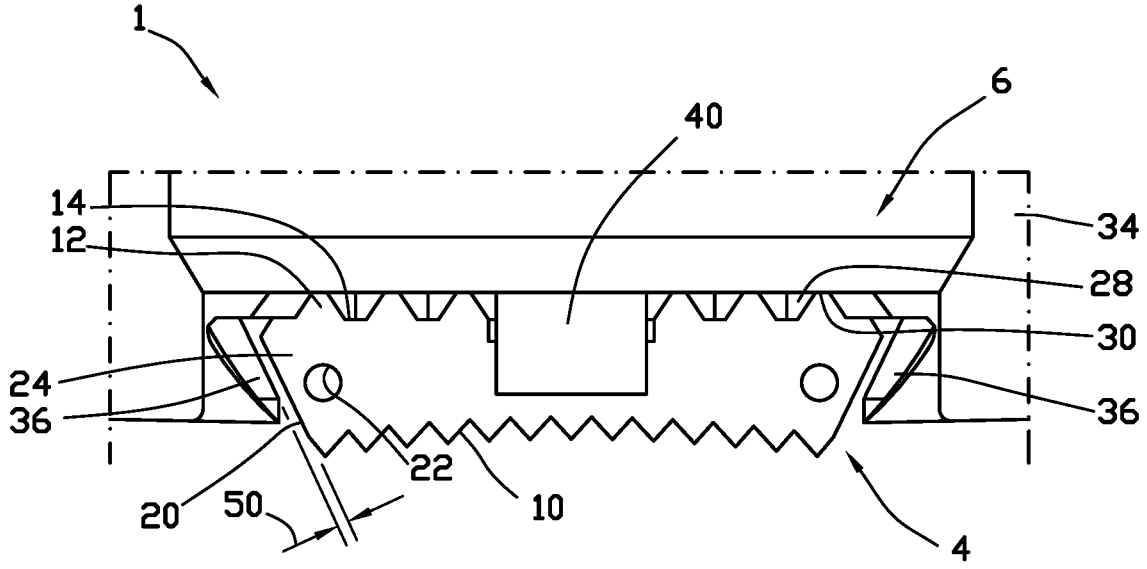
FIG. 4 shows to a larger scale a section from FIG. 3.
Figure 5:
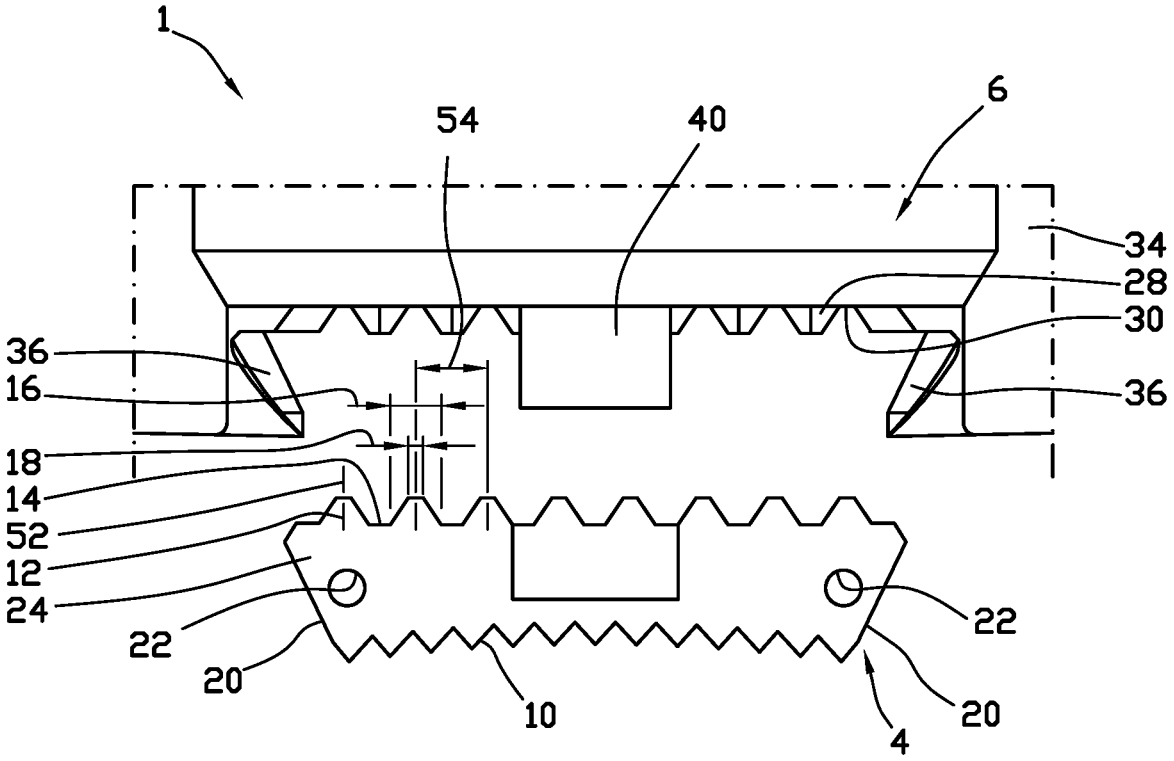
FIG. 5 shows the same as in FIG. 4, but in an exploded view.
Figure 6:
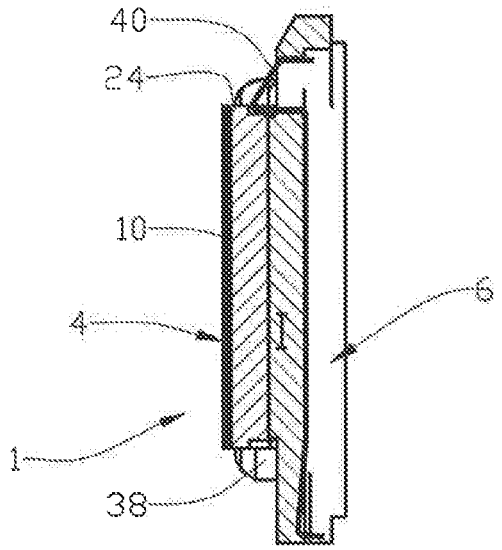
FIG. 6 shows a section III-III in FIG. 3, a tubular member is not shown.

As indicated on FIGS. 3 and 4, there is a substantial clearance 50 between the side portions 20 of the die 4 and the stop members 36 of the die holder 6 when the die 4 is engaged in the die holder 6. This clearance allows the die 4 some radial movement in the die holder 6 when the tubular member 2 is released. This feature, together with the tapered form of the die ridges 12 and the fact that the centre lines 52 of the die ridges 12 are substantially parallel with a distance 54, see FIG. 5, render the die 4 unfixed to the die holder 6 even when some deformation of the die 4 is experienced.

The distance 54 may vary between pairs of die ridges 12.

In one embodiment, a magnet 56 is fixed at least at the die 4 or the die holder 6, here at the die holder 6. When unengaged in the die holder 6, the die 4 is biased towards the die holder 6 to avoid matter entering between the ridges 12, 28 and valleys 14, 30 of the die 4 and die holder 6. Such matter could enhance wear.

Removal of the die 4 from the die holder 6 may be undertaken in the reversed sequence from inserting the die 4 into the die holder 6.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. Apparatus for gripping a tubular member, the apparatus comprising:

a die and a die holder, with the die having at least two first ridges and at least two first valleys axially formed on a portion facing the die holder and the die holder having at least two second ridges and at least two second valleys axially formed on a portion facing the die, wherein the at least two first ridges of the die complementarily fit in the at least two second valleys of the die holder, and the at least two second ridges of the die holder complementarily fit in the at least two first valleys of the die, each of the at least two first ridges having a larger bottom width than a top width in a radial direction from the die to the die holder, a lock member movable between a protruding active position and a passive retracted position, wherein the lock member is biased towards the protruding active position which locks the die in the die holder, wherein radial center lines of the at least two first ridges are substantially parallel, and wherein the die, when unengaged from the tubular member, is radially movable between abutment of the at least two first ridges of the die to the at least two second valleys of the die holder and abutment of the die to at least one stop member of the die holder with the die being movable away from the abutment with the at least two second valleys.

2. The apparatus according to claim 1, wherein the at least two second ridges are plough-formed at their upper portion.

3. The apparatus according to claim 1, wherein the at least one stop member comprises a pair of stop members and the pair of stop members forms a dove tail slot.

4. The apparatus according to claim 1, further comprising a magnet, wherein the magnet forms a portion of the at least two first ridges or a portion of the at least two second ridges, and wherein the magnet biases the die toward the die holder when the die is locked in the die holder.

5. A method for gripping a tubular member by use of an apparatus according to claim 1, the method comprising:

releasably latching a tool to the die;

sliding the die into the die holder;

then releasing the tool from the die;

gripping and releasing the tubular member;

latching the tool to the die; and retrieving the die from the die holder.

6. The method according to claim 5, further comprising releasing the lock member prior to retrieval of the die from the die holder.

7. Apparatus for gripping a tubular member having a longitudinal axis, the apparatus comprising:

a die having a first surface configured to face a die holder and having a pair of side surfaces that are tapered toward each other in a radial direction away from the die holder;

the die holder having a second surface configured to face the first surface and having two stop members forming a dovetail slot for receiving the die;

wherein the first surface comprises at least two first ridges extending substantially parallel to one another in a radial direction toward the die holder, having a bottom width proximal to the first surface that is larger than a top width that is distal from the first surface, wherein the second surface has at least two first valleys extending in the radial direction away from the die, and wherein the at least two first ridges are configured to fit within the at least two first valleys in the second surface;

wherein the die comprises a top surface and a pair of bores extending from spaced apart openings in the top surface, each bore including an internal recess spaced from the opening; and a gap between each side surface of the die and a respective one of the two stop members allows radial movement between the at least two ridges and the at least two valleys.

8. The apparatus according to claim 7 further comprising a lock member coupled to the die holder and movable between first and second positions, wherein in the first position the lock member engages the die and holds the die within the die holder, the lock member being biased towards the first position.

9. The apparatus according to claim 8 further comprising at least one support extending away from the second surface from a position axially spaced from the lock member, with the support supporting the die.

10. The apparatus according to claim 7 wherein the second surface comprises at least two second ridges extending substantially parallel to one another in the radial direction toward the die, the second ridges having a bottom width proximal to the second surface that is larger than a top width that is distal from the second surface, wherein the first surface has at least two second valleys extending in the radial direction away from the die holder, and wherein the at least two second ridges in the second surface are configured to fit within the at least two second valleys in the first surface; and wherein the at least two second ridges on the second surface are plough-formed on at least one end.

11. The apparatus according to claim 7 further comprising a magnet positioned at a location selected from the group consisting of the first surface and the second surface.

12. The apparatus according to claim 7 wherein the first surface incudes at least a first pair of ridges and a second pair of ridges, and wherein a distance between the ridges of the first pair is different from a distance between the ridges of the second pair.

* * * * *